US010555617B2

(12) United States Patent
Yu et al.

(10) Patent No.: US 10,555,617 B2
(45) Date of Patent: Feb. 11, 2020

(54) AIR POCKET MODULE AND AIR MATTRESS INCLUDING SAME

(71) Applicant: iOBED INC., Gyeonggi-do (KR)

(72) Inventors: Young Jun Yu, Gyeonggi-do (KR); Dong Hun Lee, Chungcheongnam-do (KR); Keon Yong Lee, Gyeonggi-do (KR); Dong Wook Shin, Gyeonggi-do (KR); Seung Mo Kim, Seoul (KR)

(73) Assignee: iOBED INC., Gyeonggi-Do (KR)

( * ) Notice: Subject to any disclaimer, the term of this patent is extended or adjusted under 35 U.S.C. 154(b) by 0 days.

(21) Appl. No.: 16/425,064

(22) Filed: May 29, 2019

(65) Prior Publication Data

US 2019/0274445 A1 Sep. 12, 2019

Related U.S. Application Data

(62) Division of application No. 16/041,898, filed on Jul. 23, 2018, now Pat. No. 10,362,882.

(30) Foreign Application Priority Data

Sep. 11, 2017 (KR) ..... 10-2017-0115956

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01); *A47C 27/083* (2013.01)

(58) Field of Classification Search
CPC ... A47C 27/081; A47C 27/082; A47C 27/083; A47C 27/10
See application file for complete search history.

(56) References Cited

U.S. PATENT DOCUMENTS

| | | | | | |
|---|---|---|---|---|---|
| 4,005,236 | A * | 1/1977 | Graebe | A47C 27/081 | 428/72 |
| 7,681,265 | B2 * | 3/2010 | Fraser | A47C 7/021 | 5/654 |
| D617,131 | S * | 6/2010 | Sprouse, II | D6/601 | |
| D650,214 | S * | 12/2011 | Klotz | D6/601 | |
| 2002/0013967 | A1 * | 2/2002 | Roux | A47C 27/081 | 5/654 |
| 2003/0030319 | A1 * | 2/2003 | Clapper | A47C 4/54 | 297/452.41 |
| 2008/0134440 | A1 * | 6/2008 | Mai | A47C 27/081 | 5/655.3 |
| 2011/0258783 | A1 * | 10/2011 | Rickman | A61G 7/05769 | 5/710 |
| 2014/0059781 | A1 * | 3/2014 | Lafleche | A47C 27/083 | 5/713 |

* cited by examiner

*Primary Examiner* — Nicholas F Polito
(74) *Attorney, Agent, or Firm* — The PL Law Group, PLLC

(57) ABSTRACT

An air mattress includes an air pocket unit including an air pocket module, a body portion into which the air pocket unit is inserted and fixed, a controller mounted at the body portion and controlling the air pocket unit, and a pressure sensor unit measuring pressure of the air pocket unit. The air pocket module includes multiple air pockets each having a hollow portion formed therein and configured to inflate due to air inflow or to deflate due to air outflow, and a bottom plate coupled to lower sides of the air pockets and configured to block the hollow portion of each of the air pockets.

9 Claims, 9 Drawing Sheets

AIR POCKET MODULE AND AIR MATTRESS INCLUDING SAME

CROSS-REFERENCE TO RELATED APPLICATION AND CLAIM OF PRIORITY

This application is a divisional application of application Ser. No. 16/041,898, filed on Jul. 23, 2018, which claims priority to and the benefit of Korean Patent Application No. 10-2017-0115956, filed on Sep. 11, 2017, the disclosure of which are incorporated herein by reference in its entirety.

TECHNICAL FIELD

The present invention relates to an air pocket module and an air mattress including the same, wherein pressure adjustment of the mattress is possible for each part of a user's body.

BACKGROUND ART

In general, a mattress for a bed is a spring type mattress having a coil spring therein. However, the spring type mattress is problematic in that impacts applied to a local area of the mattress are transmitted to a surrounding area thus causing vibration. The spring type mattress is also problematic in that elasticity of the coil spring is set at the time of manufacturing so that a user may not arbitrarily adjust a degree of cushioning, and elasticity of the coil spring may be deteriorated after long-term use of the mattress.

In an effort to overcome the drawbacks of such a spring mattress, an air mattress filled with air is used.

An air mattress is generally configured to have air injected thereinto to provide proper cushioning due to air pressure formed therein. The air mattress is comprised of a cushion portion having multiple air pockets, a bottom plate bonded to a lower surface of the cushion portion, and a frame assembly supporting a side surface of the cushion portion.

However, the air mattress in the related art is problematic in that changing of air pressure set at the time of manufacturing may be impossible. Accordingly, adjusting of pressure of the mattress for each part of a user's body according to a user's body type may be impossible, and adjusting of air pressure of the mattress according to user's health condition may be impossible.

Furthermore, the air mattress may be depressed at an upper portion due to the weight of a user, thereby failing to function properly as an air mattress.

Furthermore, it may be difficult for a user to adjust pressure of the air mattress as desired.

SUMMARY

Accordingly, the present invention has been made keeping in mind the above problems occurring in the related art, and an objective of the present invention is to provide an air pocket module and an air mattress including the same, wherein pressure adjustment of the mattress is possible for each part of a user's body.

Another objective of the present invention is to provide an air pocket module and an air mattress including the same, wherein pressure adjustment of the mattress is possible according to body condition and health condition of a user.

A further objective of the present invention is to provide an air pocket module and an air mattress including the same, wherein an upper portion of an air pocket is protected such that the air pocket is prevented from being depressed due to the weight of a user.

In order to accomplish the above objectives according to one aspect of the present invention, there is provided an air pocket module 100 inserted into an air mattress and including: multiple air pockets 110 each having a hollow portion formed therein and configured to inflate due to air inflow or to deflate due to air outflow; and a bottom plate 130 coupled to lower sides of the air pockets 110 and configured to block the hollow portion of each of the air pockets 110, wherein the air pocket 110 includes: a top surface portion 1110 forming a top surface; a side surface portion 1120 connected with the top surface portion 1110 and forming a side surface; and a contact portion 1140 protruding upwardly from a center of the top surface portion 1110.

Furthermore, the air pocket 110 may include a first connection portion 1130 formed at an edge portion of the air pocket where the top surface portion 1110 and the side surface portion 1120 are connected to each other to connect the top surface portion 1110 and the side surface portion 1120 to each other, wherein the first connection portion 1130 may be formed to be inclined from the top surface portion 1110 toward the side surface portion 1120.

Furthermore, the side surface portion 1120 may include: a first side surface 1121 including two surfaces facing each other; and a second side surface 1122 including two other surfaces facing each other.

Furthermore, the first side surface 1121 may include a first inflation portion 1151 formed concavely toward the hollow portion such that side surface portions 1120 of adjacent ones of the multiple air pockets 110 are prevented from coming into contact with each other when the air pockets 110 inflate.

Furthermore, the second side surface 1122 may include multiple second inflation portions 1152 each formed concavely toward the hollow portion such that side surface portions 1120 of adjacent ones of the multiple air pockets 110 are prevented from coming into contact with each other when the air pockets 110 inflate.

Furthermore, the second side surface 1122 may include a support portion 1160 protruding outwardly of the air pocket 110 at a position between the multiple second inflation portions 1152, and an upper end of the support portion 1160 may be connected with the contact portion 1140 to improve supportability of the contact portion 1140.

Furthermore, the first side surface 1121 may include a first reinforcing portion 1171 formed in a curved shape to be inclined inwardly from the first connection portion 1130 toward a lower end of the side surface portion 1120, and the first reinforcing portion 1171 may be configured such that a width thereof decreases gradually from the first connection portion 1130 to a lower portion of the side surface portion 1120.

Furthermore, the second side surface 1122 may include a second reinforcing portion 1172 formed in a curved shape to be inclined inwardly from the first connection portion 1130 toward a lower end of the support portion 1160, and the second reinforcing portion 1172 may be configured such that a width thereof decreases gradually from the first connection portion 1130 to a lower portion of the support portion 1160.

Furthermore, the air pocket 110 may include a second connection portion 1180 connected to a lower portion of the air pocket 110 and the bottom plate 130, and the second connection portion 1180 may be formed to be inclined outwardly from a peripheral end of the air pocket 110 toward the bottom plate 130.

Furthermore, the multiple air pockets 110 may be arranged in each of a horizontal direction and a vertical direction to form multiple rows and multiple columns, and a first flow passage 141 may be provided to allow adjacent air pockets 110 in each row to communicate with each other, and a second flow passage 142 may be provided to allow adjacent air pockets 110 in each column to communicate with each other.

Furthermore, the multiple air pockets 110 may be arranged in four rows×five columns, and the first flow passage 141 may be formed such that the air pockets 110 in each of a first row, a second row, a third row, and a fourth row communicate with each other, and the second flow passage 142 may be formed between the first row and the second row such that the air pockets 110 of the first row and the second row communicate with each other.

According to another aspect of the present invention, there is provided an air mattress 10 including the air pocket module 100 and including: an air pocket unit 11 including at least one air pocket module 100; a body portion 12 into which the air pocket unit 11 is inserted and fixed; a controller 13 mounted at the body portion 12 and controlling the air pocket unit 11; and a pressure sensor unit 14 measuring pressure of the air pocket unit 11, wherein the air pocket module 100 includes: multiple air pockets 110 each having a hollow portion formed therein and configured to inflate due to air inflow or to deflate due to air outflow; and a bottom plate 130 coupled to lower sides of the air pockets 110 and configured to block the hollow portion of each of the air pockets 110.

Furthermore, the air pocket module 100 may be configured such that the multiple air pockets 110 are arranged in each of a horizontal direction and a vertical direction to form multiple rows and multiple columns and may include: a first flow passage 141 allowing adjacent air pockets 110 in each row to communicate with each other; and a second flow passage 142 allowing adjacent air pockets 110 in each column to communicate with each other.

Furthermore, the bottom plate 130 may include: multiple nozzles 131 supplying or discharging air to or from the air pockets 110 and allowing the rows of the air pockets 110 to communicate with each other; a supply line 132 connected to the nozzles 131 to supply or discharge the air to or from the air pockets 110; a valve 133 connected to the supply line 132 to adjust air supply from an air pump 15 to the air pockets 110 and air discharge from the air pockets 110; and a section connection line 134 connected to the nozzles 131 to allow rows of the multiple rows of the air pockets 110 to communicate with each other, the rows of the multiple rows between which the second flow passage 142 is not formed.

Furthermore, the air pocket unit 11 may include: a first air pocket module 100*a*; and a second air pocket module 100*b* disposed in contact with the first air pocket module 110*a* such that row arrangement of the air pockets 110 thereof is symmetrical with row arrangement of the air pockets of the first air pocket module 100*a*.

Furthermore, the air pocket unit 11 may include: a first section 11-1 where a user's shoulder is located and formed by at least one row of the air pocket unit 11; a second section 11-2 where a user's waist is located and formed by at least one row of the air pocket unit 11; a third section 11-3 where user's buttocks are located and formed by at least one row of the air pocket unit 11; and a fourth section 11-4 where user's thighs and knees are located and formed by multiple rows of the air pocket unit 11.

Furthermore, the controller 13 may adjust pressure of the air pockets 110 for each section of the first section 11-1, the second section 11-2, the third section 11-3, and the fourth section 11-4.

Furthermore, the bottom plate 130 may be provided with a nozzle 131 supplying and discharging air to and from the air pockets 110, wherein at least one nozzle 131 may be provided in each of the first section 11-1, the second section 11-2, the third section 11-3, and the fourth section 11-4.

Furthermore, the pressure sensor unit 14 may measure pressure of the air pockets 110 for each section of the first section 11-1, the second section 11-2, the third section 11-3, and the fourth section 11-4.

Furthermore, the air pocket unit 11 may be disposed at each of left and right sides of the body portion and may be individually controlled by the controller 13.

As described above, in the air pocket module and the air mattress including the same according to the embodiment of the present invention, pressure adjustment of the mattress is possible for each part of a user's body.

Furthermore, in the air pocket module and the air mattress including the same, pressure adjustment of the mattress is possible according to body condition and health condition of a user.

Furthermore, in the air pocket module and the air mattress including the same, an upper portion of the air pocket can be protected such that the air pocket can be prevented from being depressed due to the weight of a user.

DETAILED DESCRIPTION

Hereinafter, exemplary embodiments of the present invention will be described in detail with reference to the accompanying drawings. It should be noted that the embodiments of the present invention are disclosed only for illustrative purposes and should not be construed as limiting the present invention.

In the following description of the present invention, detailed descriptions of known functions and components incorporated herein will be omitted when it may make the subject matter of the present invention unclear. Furthermore, technical terms, as will be mentioned hereinafter, are terms defined in consideration of their function in the present invention, which may be varied according to the intention of a user, practice, or the like, so that the terms should be defined based on the contents of this specification.

The technical sprit of the present invention is defined by the accompanying claims, and the following embodiments are presented for those skilled in the art to be able to more clearly understand the spirit of the present invention.

Figure 1:
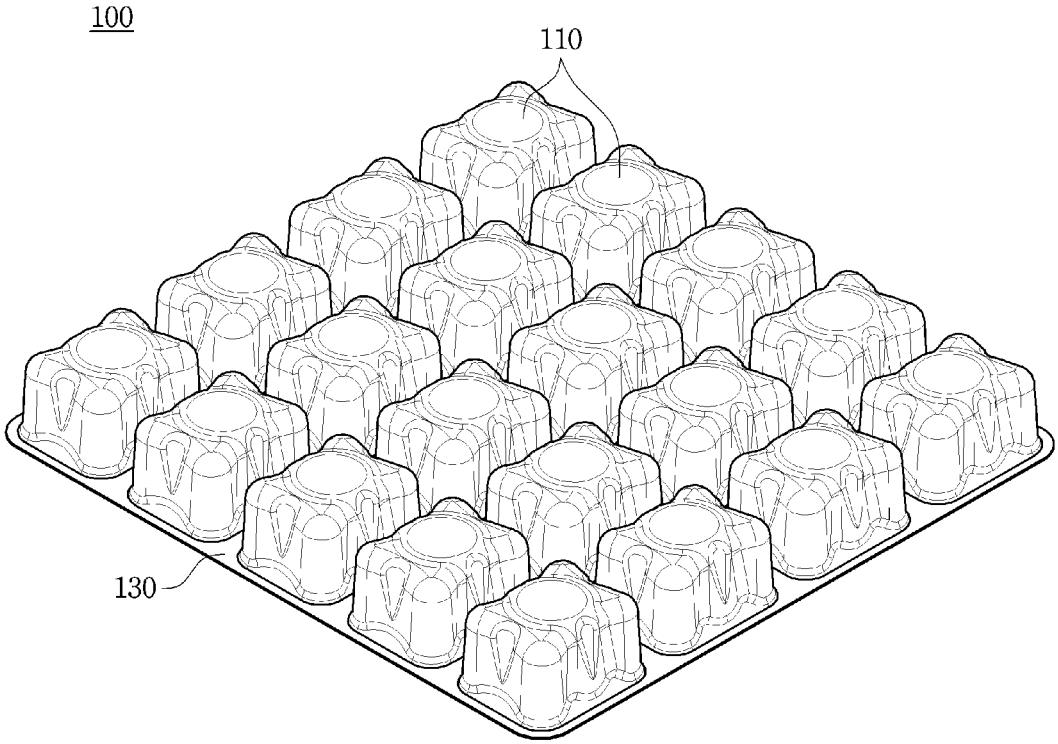
FIG. 1 is a perspective view showing an air pocket module according to an embodiment of the present invention.
Figure 2:
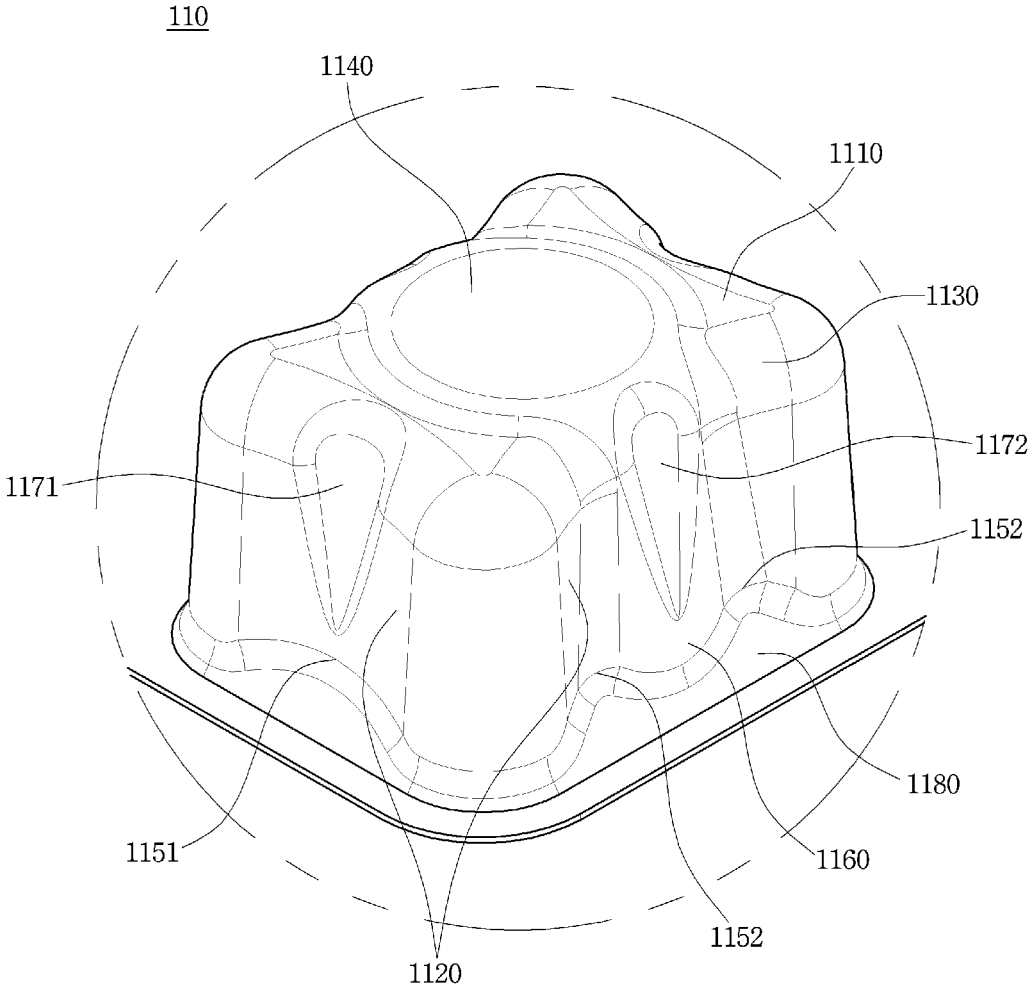
FIG. 2 is a perspective view showing an air pocket according to FIG. 1.
Figure 3:
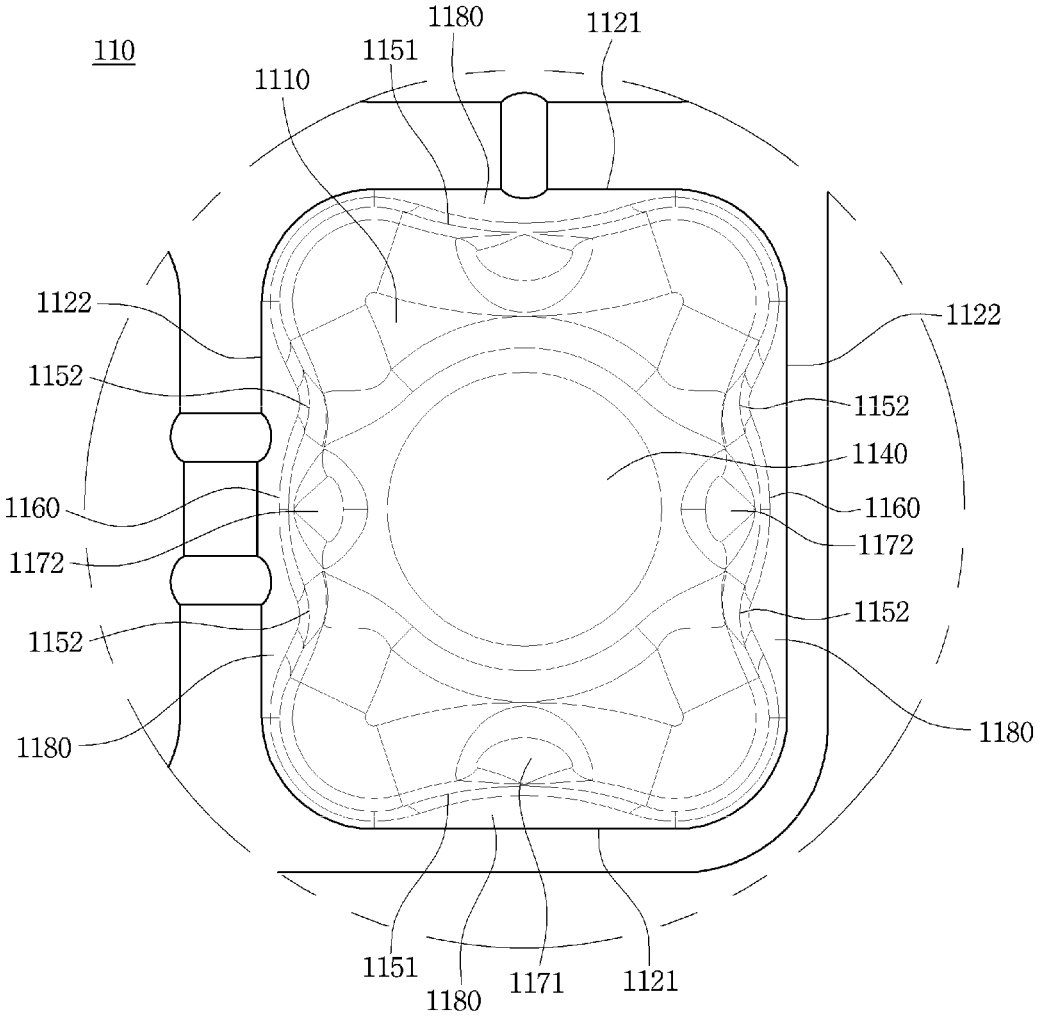
FIG. 3 is a plan view showing the air pocket according to FIG. 2.

FIG. 1 is a perspective view showing an air pocket module according to an embodiment of the present invention, FIG. 2 is a perspective view showing an air pocket according to FIG. 1, and FIG. 3 is a plan view showing the air pocket according to FIG. 2.

Referring to FIGS. 1 to 3, an air pocket module 100 is inserted into an air mattress 10 on which a user sits or lies down. Specifically, the air pocket module is used for an air mattress 10 for a bed.

The air pocket module 100 includes multiple air pockets 110 and a bottom plate 130.

Each of the air pockets 110 has a hollow portion formed therein and is configured to inflate due to air inflow or deflate due to air outflow. The air pocket 110 includes multiple surfaces.

Herein, referring to FIGS. 2 and 3, the air pocket 110 includes a top surface portion 1110, a side surface portion 1120, a first connection portion 1130, a contact portion 1140, a first inflation portion 1151, a second inflation portion 1152, a first reinforcing portion 1171, a second reinforcing portion 1172, and a second connection portion 1180.

The top surface portion 1110 forms a top surface of the air pocket 110. The top surface portion 1110 is a portion that supports a user when a user lies on the air mattress 10 and may be a portion that directly receives a load of a user. The top surface portion 1110 is depressed due to the load of a user.

The side surface portion 1120 is connected with the top surface portion 1110 to form a side surface of the air pocket 110.

In the present embodiment, the side surface portion 1120 is comprised of a total of four surfaces, and the top surface portion 1110 has a rectangular shape without being limited thereto. However, the side surface portion 1120 may include five side surfaces, and the top surface portion 1110 may have a pentagonal shape or various other shapes.

The side surface portion 1120 includes a first side surface 1121 and a second side surface 1122. Specifically, the side surface portion 1120 is comprised of four surfaces, and two facing surfaces of the four surfaces are referred to as first side surfaces 1121, and another two facing surfaces are referred to as second side surfaces 1122.

The first connection portion 1130 is formed at an edge portion where the top surface portion 1110 and the side surface portion 1120 are connected to each other to connect the top surface portion 1110 and the side surface portion 1120 to each other. In other words, the first connection portion 1130 is formed at the edge portion where the top surface portion 1110 and the side surface portion 1120 are connected to each other. The first connection portion 1130 is inclined from the top surface portion 1110 toward the side surface portion 1120.

The inclined first connection portion 1130 disperses the load of a user applied to the top surface portion 1110 and prevents deformation or depression of the top surface portion 1110 pressed by the load of a user. Specifically, the top surface portion 1110, which receives the load of a user, is pressed toward the bottom plate 130, that is, inwardly of the air pocket 110 due to the load of a user. Herein, in a case where the top surface portion 1110 and the side surface portion 1120 are directly vertically connected to each other, when the top surface portion 1110 is pressed inwardly of the air pocket 110 due to the load, a height difference occurs at the edge portion where the top surface portion 1110 and the side surface portion 1120 are connected to each other. When such a height difference occurs repeatedly, the edge portion may be easily depressed and the air pocket 110 may be broken. To prevent this, the first connection portion 1130 is formed to have a predetermined inclination. Even when the top surface portion 1110 receives the load, the height difference is reduced due to the inclination of the first connection portion 1130. Thus, the top surface portion 1110 and the side surface portion 1120 can be prevented from being depressed or broken due to the load.

The contact portion 1140 is a portion that protrudes upwards from a center of the top surface portion 1110 to support a user. In other words, the contact portion 1140 protrudes upwards from the top surface portion 1110 by a predetermined height difference therebetween. Thus, pressure applied to the top surface portion 1110 due to the load of a user is dispersed whereby the top surface portion 1110 can be protected from depression or deformation. Herein, the predetermined height difference may indicate a degree that a user does not feel discomfort when lying on the air mattress 10.

Specifically, in order to prevent the top surface portion 1110 directly receiving the load from being depressed, the contact portion 1140 protrudes from the center of the top surface portion 1110. Thus, when a user sits down or lies on the air mattress 10, the load of a user is applied firstly to the contact portion 1140. The load of a user is applied firstly to the contact portion 1140 and is then applied to the top surface portion 1110. In addition, since the contact portion 1140 protrudes, the top surface portion 1110 is directly depressed by the load of a user. Thus, when a user sits down or lies on the air mattress, the contact portion 1140 can protect the top surface portion 1110 against the load of a user that is applied to the air pocket 110.

The first inflation portion 1151 is included in the first side surface 1121. The first inflation portion 1151 is concavely formed toward the hollow portion such that when the air pockets 110 inflate, the side surface portions 1120 of each of the multiple air pockets 110 and an adjacent air pocket are prevented from coming into contact with each other.

The second inflation portion 1152 is included in the second side surface 1122. The second inflation portion 1152 is concavely formed toward the hollow portion such that when the air pockets 110 inflate, the side surface portions 1120 of each of the multiple air pockets 110 and an adjacent air pocket are prevented from coming into contact with each other. Furthermore, multiple second inflation portions 1152 are formed on each of the second side surfaces 1122.

Specifically, when air is supplied into the air pockets 110, the air pockets 110 inflate. When adjacent air pockets 110 inflate and come into contact with each other, a desired pressure of each air pocket 110 is inhibited from being formed. To prevent this, the first inflation portion 1151 and the second inflation portion 1152 are formed on the side surface portion 1120 to be concavely formed toward the hollow portion of the air pocket 110 at a predetermined depth.

The support portion 1160 is included in the second side surface 1122. The support portion 1160 protrudes outwardly of the air pocket 110 at a position between the multiple second inflation portions 1152 formed on each of the second side surfaces 1122. In other words, the support portion 1160 is formed between the two second inflation portions 1152.

The support portion 1160 has an upper end connected with the contact portion 1140 to improve supportability of the contact portion 1140.

The first reinforcing portion 1171 is included in the first side surface 1121. The first reinforcing portion 1171 is inclined inwardly from the first connection portion 1130 toward a lower end of the first side surface 1121. In addition, the first reinforcing portion 1171 is configured such that a width thereof gradually decreases from the first connection portion 1130 to a lower portion of the first side surface 1121.

The second reinforcing portion 1172 is included in the second side surface 1122. The second reinforcing portion 1172 is inclined inwardly from the first connection portion 1130 toward a lower end of the support portion 1160. The second reinforcing portion 1172 is configured such that a width thereof gradually decreases from the first connection portion 1130 to a lower portion of the support portion 1160.

The first reinforcing portion 1171 and the second reinforcing portion 1172 prevent the air pocket 110 from collapsing or being abnormally depressed as stress is concentrated on the edge portion (i.e., the first connection portion 1130) where the top surface portion 1110 and the side surface portion 1120 are connected to each other due to the load of a user applied thereto. In other words, the first reinforcing portion 1171 and the second reinforcing portion 1172 prevent deformation of the top surface portion 1110 from the load applied to the top surface portion 1110, thereby improving strength of the air pocket 110.

The first reinforcing portion 1171 and the second reinforcing portion 1172 are formed in a groove shape such that widths thereof gradually decrease from the first connection portion 1130 to a lower portion of the side surface portion 1120. A reinforcing portion 1170 is formed in a protrusion shape, but it is preferable that the reinforcing portion 1170 is formed in a groove shape because the protrusion shape may cause user discomfort.

The second connection portion 1180 is connected to a lower portion of the air pocket 110 and the bottom plate 130.

The second connection portion 1180 is formed to be inclined outwardly from a peripheral end of the air pocket 110 toward the bottom plate 130.

The bottom plate 130 is coupled to lower sides of the multiple air pockets 110 to block hollow portions of the air pockets 110. The bottom plate 130 may have a plate shape. The bottom plate 130 is provided with a nozzle 131 (see FIG. 6) through which air is supplied and discharged to and from the air pockets 110. A detailed description of the nozzle 131 will be given later with reference to FIG. 6.

Figure 4:
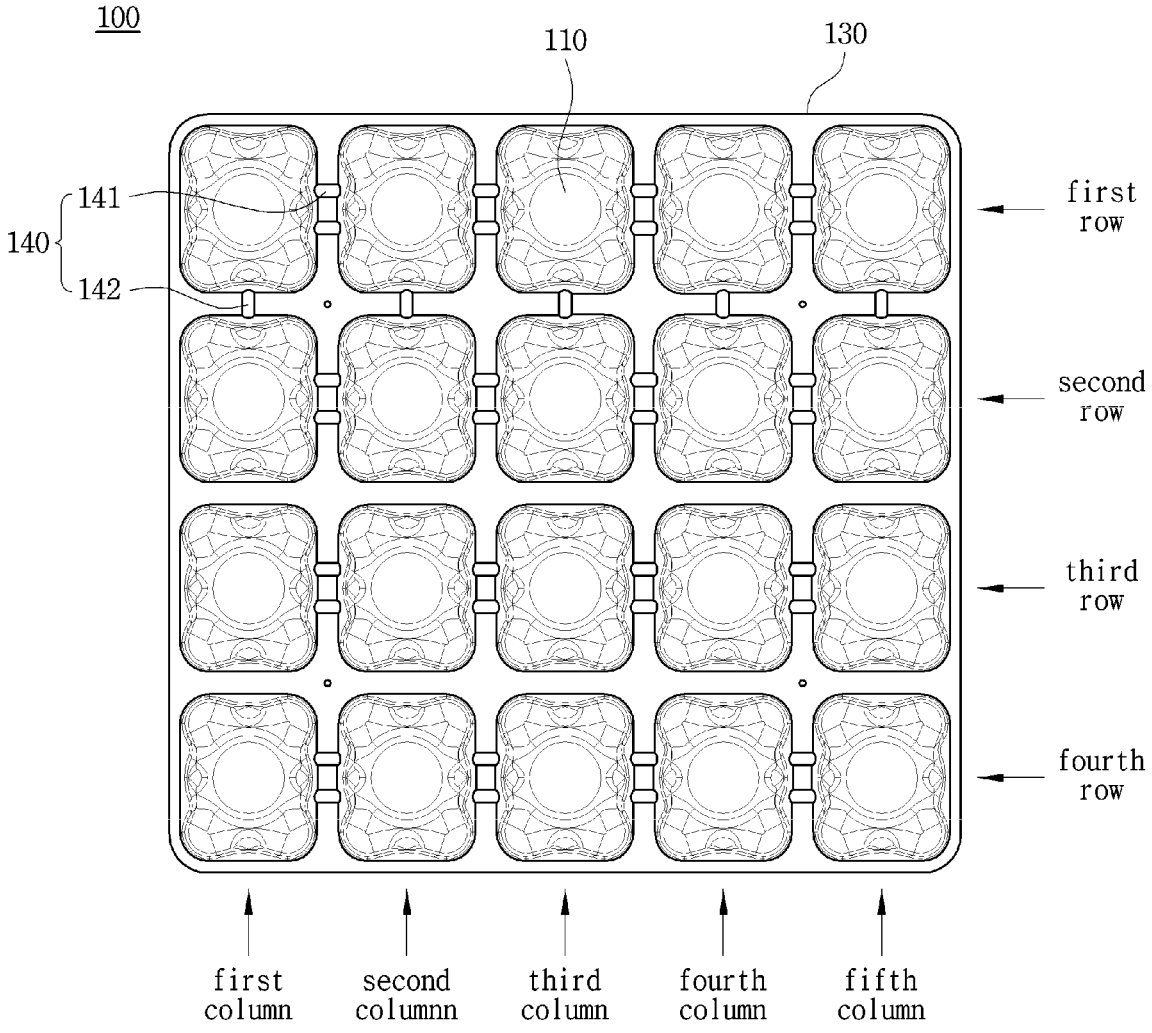
FIG. 4 is a plan view showing the air pocket module according to FIG. 1.

FIG. 4 is a plan view showing an air pocket module according to FIG. 1.

Referring to FIG. 4, the air pocket module 100 includes the multiple air pockets 110. Specifically, the multiple air pockets 110 are arranged in each of horizontal and vertical directions to form multiple rows and multiple columns, thereby forming one air pocket module 100.

In the present embodiment, the air pocket module 100 including the air pockets 110 arranged in four rows×five columns will be described as an example.

The air pocket module 100 includes a flow passage 140 communicating with the multiple air pockets 110. Specifically, the flow passage 140 includes a first flow passage 141 and a second flow passage 142.

The first flow passage 141 allows adjacent air pockets 110 in each row to communicate with each other. In other words, the first flow passage 141 allows adjacent air pockets 110 arranged in the horizontal direction to communicate with each other. At least one first flow passage 141 is provided between adjacent air pockets 110. It is preferable that two first flow passages 141 are provided between adjacent air pockets 110.

The second flow passage 142 allows adjacent air pockets 110 in each column to communicate with each other. In other words, the second flow passage 142 allows adjacent air pockets 110 arranged in the vertical direction to communicate with each other.

The first flow passage 141 is provided in each of a first row, a second row, a third row, and a fourth row. The second flow passage 142 is provided between the first row and the second row to allow the air pockets 110 in the first row and the second row to communicate with each other. In other words, the first row, the second row, the third row, and the fourth row of the air pocket module 100 are configured such that the air pockets 110 arranged in each row are allowed to communicate with each other by the first flow passage 141. Furthermore, the second flow passage 142 is provided between the first row and the second row to allow the first row and the second row to communicate with each other.

Figure 5:
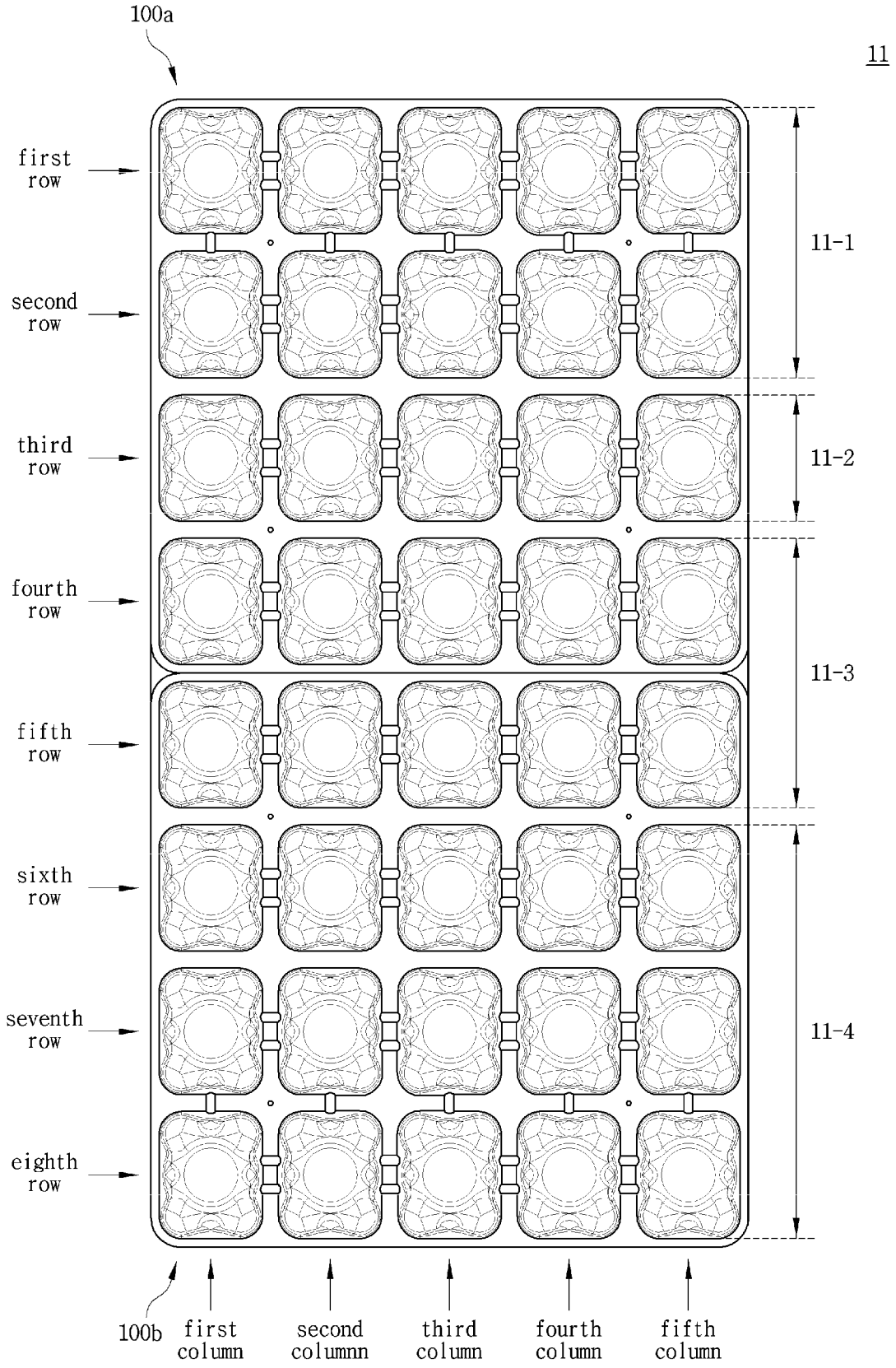
FIG. 5 is a plan view showing an air pocket unit according to the embodiment of the present invention.

FIG. 5 is a plan view showing an air pocket unit according to the embodiment of the present invention.

Referring to FIG. 5, the air mattress 10 includes an air pocket unit 11.

The air pocket unit 11 includes at least one air pocket module 100. Specifically, the air pocket unit 11 includes a pair of air pocket modules 100.

The pair of air pocket modules 100 includes a first air pocket module 100*a* and a second air pocket module 100*b*. The first air pocket module 100*a* and the second air pocket module 100*b* are disposed such that row arrangements of the air pockets 110 of the first and second air pocket modules are symmetrical with each other.

Specifically, the first air pocket module 100*a* is disposed. Then, the second air pocket module 100*b* is disposed in contact with the first air pocket module 100*a* such that the row arrangement thereof is symmetrical with the row arrangement of the first air pocket module 100*a*.

Referring to the air pocket unit 11 in which the first air pocket module 100*a* and the second air pocket module 100*b* are in contact with each other, a first row and a second row of the first air pocket module 100*a* are allowed to communicate with each other by the second flow passage 142, while a third row and a fourth row of the second air pocket module 100*b* are allowed to communicate with each other by the second flow passage 142.

Hereinafter, with reference to FIG. 5, the air pocket unit 11 including the air pockets 110 arranged in eight rows×five columns will be described as an example.

The air pocket unit 11 is configured such that the multiple air pockets 110 in each of the first to eighth rows are allowed to communicate with each other by the first flow passage 141. In addition, the first row and the second row are allowed to communicate with each other by the second flow passage 142, and the seventh row and the eighth row are allowed to communicate with each other by the second flow passage 142.

The air pocket unit 11 composed of eight rows×five columns is divided into multiple sections. Herein, the air pocket unit is divided into the multiple sections depending on a position where the body part of a user is located.

As an example, the air pocket unit 11 is divided into a first section 11-1, a second section 11-2, a third section 11-3, and a fourth section 11-4.

The first section 11-1 is where a user's shoulder is located and is formed by at least one row of the air pocket unit 11.

The second section 11-2 is where a user's waist is located and is formed by at least one row of the air pocket unit 11.

The third section 11-3 is where user's buttocks are located and is formed by at least one row of the air pocket unit 11.

The fourth section 11-4 is where user's thighs and knees are located and is formed by multiple rows of the air pocket unit 11.

In the present embodiment, as an example, the first section 11-1 is formed by two rows, the second section 11-2 is formed by one row, the third section 11-3 is formed by two rows, and the fourth section 11-4 is formed by three rows.

A fifth section (not shown) may be where user's head or user's feet are located. The section where the user's head is located may be provided as a general mat without having the air pockets 110 being arranged. In general, the section where the user's head is located may not be provided with the air pockets 110 because a user may use a pillow, or a pressure change of the air pockets may not be required. Likewise, the section where the user's feet are located may also not have the air pockets 110 being arranged. However, the present invention is not limited thereto, and the air pockets 110 may be arranged in the section where the user's head or user's feet are located, and the pressure of the air pockets may be adjusted.

In addition, an interval between each row of the air pockets 110 arranged in the air pocket unit 11 may be 150 mm. This is an interval such that the air pockets 110 may not interfere with each other when adjacent ones of the air pockets 110 inflate. Furthermore, an interval between each column may be 125 mm without being limited thereto.

Figure 6:
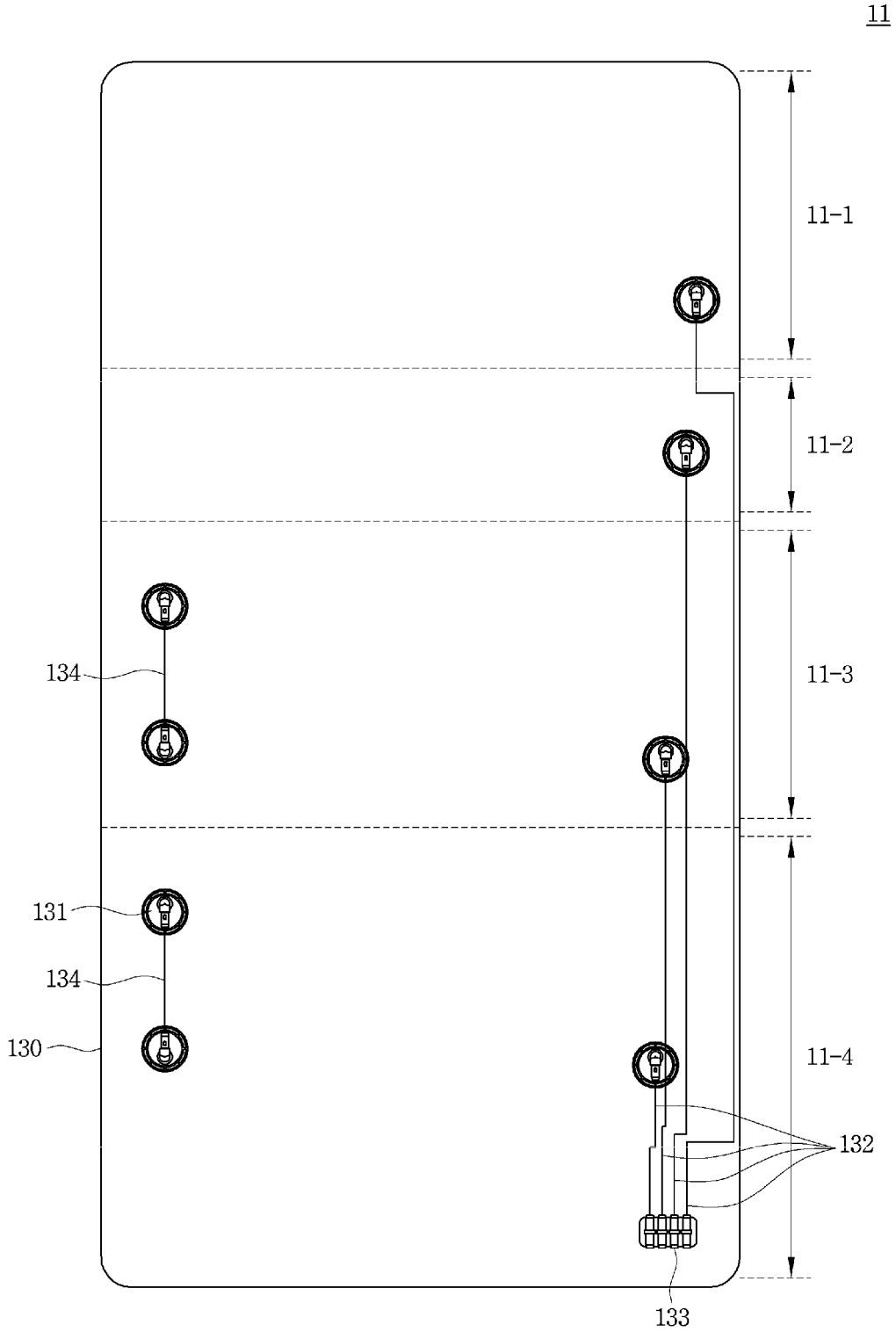
FIG. 6 is a bottom view showing the air pocket unit according to FIG. 5.

FIG. 6 is a view showing the bottom plate of the air pocket unit according to FIG. 5.

Referring to FIG. 6, the bottom plate 130 is provided with the nozzle 131, a supply line 132, a valve 133, and a section connection line 134.

The nozzle 131 may be an inlet for allowing air to be supplied to and discharged from the air pockets 110. At least one nozzle 131 is provided in each of the first section 11-1, the second section 11-2, the third section 11-3, and the fourth section 11-4. Since the nozzle 131 is provided in each section, the pressure of the air pockets 110 is adjusted for each section of the air pocket unit 11.

However, in the present embodiment, one nozzle 131 communicating with the supply line 132 is provided for each section, but the present invention is not limited thereto. For example, multiple nozzles 131 may be provided in a section where pressure change of the air pockets 110 is large. In the third section 11-3 where the user's buttocks are located and the fourth section 11-4 where the user's thighs and knees are located, there is a large pressure change due to a large body load. Accordingly, the multiple nozzles 131 may be provided in the third section 11-3 and the fourth section 11-4. For example, two nozzles 131 are arranged in the first section 11-1, one nozzle 131 is arranged in the second section 11-2, three nozzles 131 are arranged in the third section 11-3, and two nozzles 131 are arranged in the fourth section 11-4. Furthermore, the nozzle 131 may be arranged at each of opposite sides of the bottom plate 130.

In addition, the nozzle 131 communicates with the section connection line 134 as well as the supply line 132. For example, multiple nozzles 131 are provided in the third section 11-3 to allow the fourth row and the fifth row, which do not communicate with each other, to communicate with each other. Likewise, multiple nozzles 131 are provided in each of the sixth row and the seventh row to allow the sixth row and the seventh row, which do not communicate with each other, to communicate with each other.

The supply line 132 connects the nozzle 131 and the valve 133 with each other. Multiple supply lines 132 communicate with the multiple nozzles 131, respectively. Each of the supply line 132 is configured such that air supply and air discharge to and from the air pockets 110 are switched by the valve 133.

The valve 133 adjusts air supply from an air pump 15 (see FIG. 9) to the air pockets 110 and air discharge from the air pockets 110. The valve 133 may be a solenoid valve. However, the present invention is not limited thereto and may include various types of valves 133.

The section connection line 134 allows a row of the third section 11-3 and a row of the fourth section 11-4, which do not communicate with each other by the second flow passage 142, to communicate with each other.

Specifically, the section connection line 134 allows the fourth row and the fifth row of the third section 11-3, which do not communicate with each other, to communicate with each other. In other words, the section connection line 134 is connected to the nozzle 131 provided in each of the fourth row and the fifth row so as to allow the fourth row and the fifth row of the air pockets 110 to communicate with each other.

Likewise, the section connection line 134 allows the sixth row and the seventh row of the fourth section 11-4, which do not communicate with each other, to communicate with each other. In other words, the section connection line 134 is connected to the nozzle 131 provided in each of the sixth row and the seventh row so as to allow the rows of air pockets 110 in the fourth section 11-4 to communicate with each other.

Figure 7:
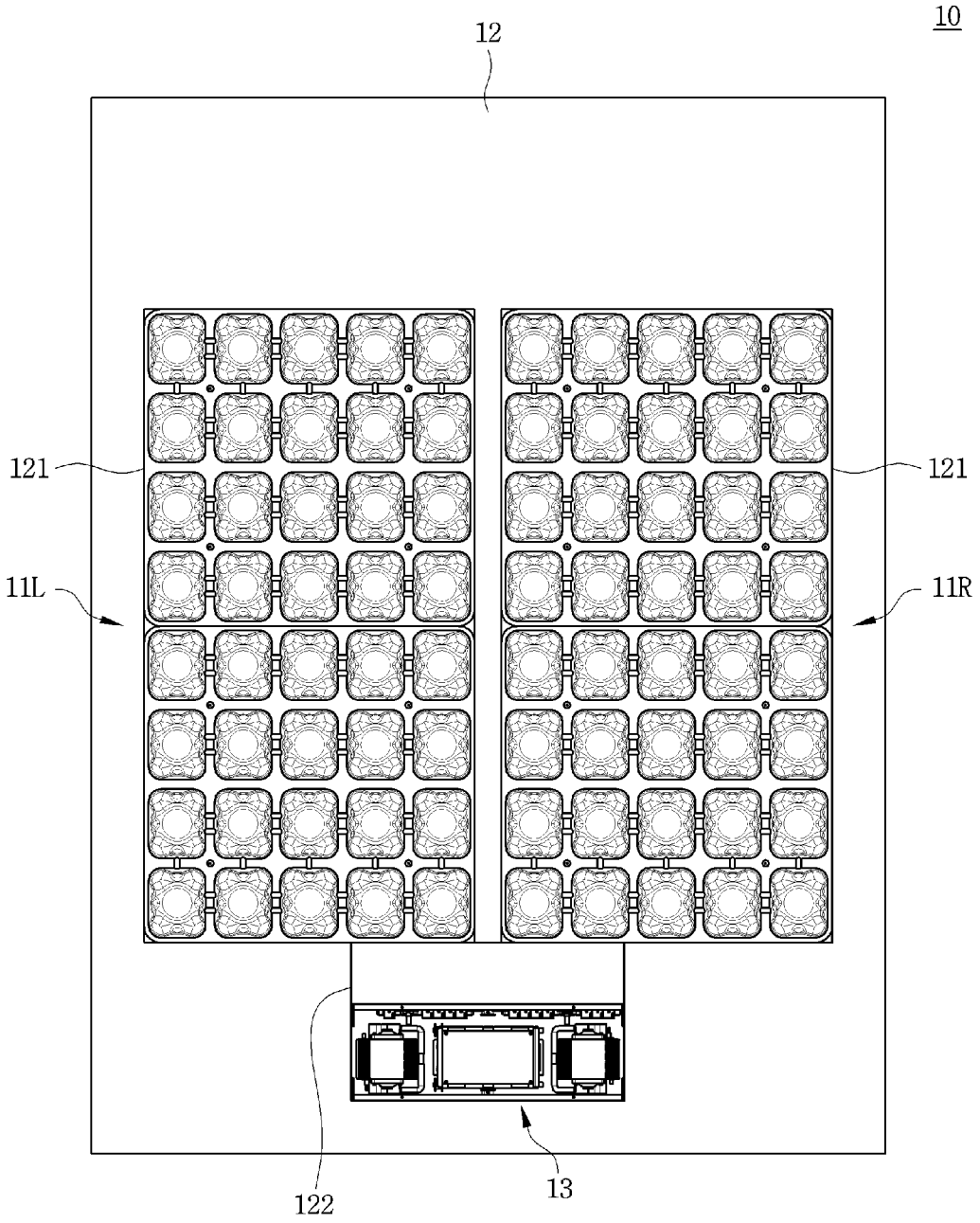
FIG. 7 is a view showing an air mattress according to an embodiment of the present invention.
Figure 8:
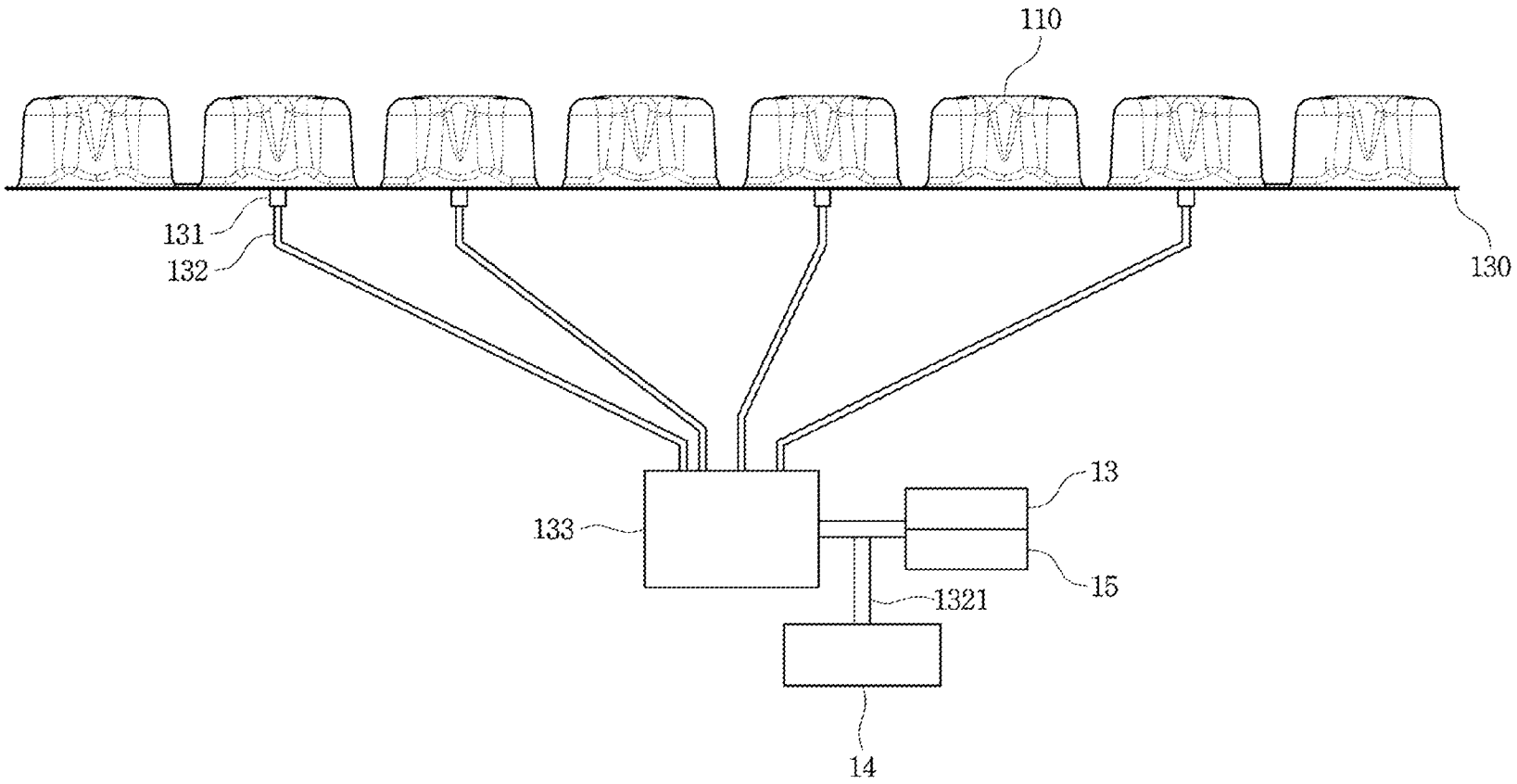
FIG. 8 is a schematic view showing the air mattress according to the embodiment of the present invention.
Figure 9:
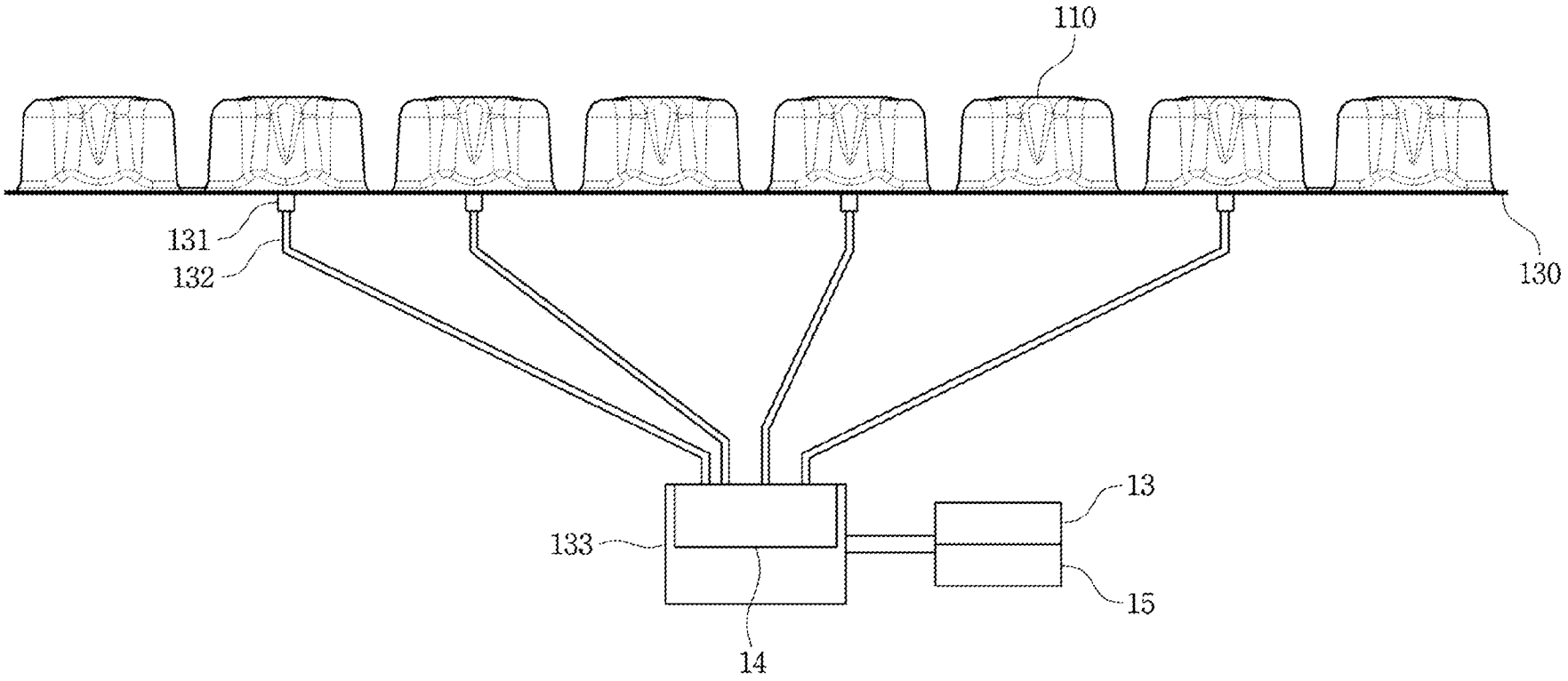
FIG. 9 is a view showing another embodiment of a pressure sensor unit of the air mattress according to FIG. 8.

FIG. 7 is a view showing an air mattress according to an embodiment of the present invention, FIG. 8 is a schematic view showing the air mattress according to the embodiment of the present invention, and FIG. 9 is a view showing another embodiment of a pressure sensor unit of the air mattress according to FIG. 8.

Referring to FIGS. 7 to 9, an air mattress 10 includes an air pocket unit 11, a body portion 12, a mattress controller 13, a pressure sensor unit 14, and an air pump 15.

At least one air pocket unit 11 is inserted into the body portion 12. In the present embodiment, two air pocket units 11 inserted into the body portion 12 are described as an example. Specifically, a first air pocket unit 11L and a second air pocket unit 11R are respectively arranged at left and right sides of the body portion 12. The first air pocket unit 11L and the second air pocket unit 11R are individually controlled by the mattress controller 13.

The body portion 12 forms the overall shape of the air mattress 10, and the air pocket unit 11 is inserted thereinto. The body portion 12 is provided with an air pocket unit fixing portion 121 where the air pocket unit 11 is inserted. In addition, the body portion is provided with a controller fixing portion 122 where the mattress controller 13 is mounted.

The mattress controller 13 is mounted at the body portion 12. The mattress controller 13 controls the air mattress 10. Specifically, the mattress controller adjusts the pressure of the air pocket unit 11. The mattress controller 13 adjusts the pressure of the multiple air pockets 110 arranged in each of the first section 11-1, the second section 11-2, the third section 11-3, and the fourth section 11-4.

In addition, the mattress controller 13 individually controls the first air pocket unit 11L and the second air pocket unit 11R respectively arranged at the left and right sides of the body portion 12.

The pressure sensor unit 14 measures the pressure of the air pocket unit 11.

The pressure sensor unit 14 measures the pressure of the air pockets 110 and possibly measures the pressure of each section of the first section 11-1, the second section 11-2, the third section 11-3, and the fourth section 11-4.

Based on the pressure measured by the pressure sensor unit 14, the mattress controller 13 controls air supply and air discharge to and from the air pockets 110 in each of the first section 11-1, the second section 11-2, the third section 11-3, and the fourth section 11-4 to adjust the pressure of the air pockets 110.

Referring to FIG. 8, one pressure sensor unit 14 is provided. In this case, the pressure sensor unit 14 is connected with a main supply line 1321 to measure the pressure of each of the supply lines 132.

Referring to FIG. 9, multiple pressure sensor units 14 are provided. The pressure sensor units 14 are disposed in the valve 133 and each of the pressure sensor units is connected to each of the supply lines 132. The pressure sensor unit 14 connected to the supply line 132 measures the pressure of the air pockets 110 in each section.

Based on the pressure measured by the pressure sensor unit 14, the mattress controller 13 adjusts the pressure of the air pockets 110.

The air pump 15 supplies air to the air pockets 110 through the supply lines 132.

While the present invention has been particularly shown and described with reference to exemplary embodiments thereof, it will be understood by those of ordinary skill in the art that various changes and modifications may be made therein without departing from the technical spirit of the present invention. Therefore, the scope of the invention should be determined on the basis of the descriptions in the appended claims, not any specific embodiment, and all equivalents thereof should belong to the scope of the invention.

What is claimed is:

1. An air mattress comprising:

an air pocket unit including an air pocket module;

a body portion into which the air pocket unit is inserted and fixed;

a controller mounted at the body portion and controlling the air pocket unit; and a pressure sensor unit measuring pressure of the air pocket unit, wherein the air pocket module includes:

multiple air pockets each having a hollow portion formed therein and configured to inflate due to air inflow or to deflate due to air outflow; and a bottom plate coupled to lower sides of the air pockets and configured to block the hollow portion of each of the air pockets, wherein each air pocket comprises:

a top surface portion forming a top surface; and a side surface portion connected with the top surface portion and forming a side surface, the side surface portion comprising:

a first side surface including two surfaces facing each other, the first side surface including a first inflation portion formed concavely toward the hollow portion; and a second side surface including two other surfaces facing each other and connected to edges of the first side surface, the second side surface having a width greater than a width of the first side surface, each of the two other surfaces of the second side surface including a pair of second inflation portions spaced apart from each other and each formed concavely toward the hollow portion.

2. The air mattress of claim 1, wherein the air pocket module is configured such that the multiple air pockets are arranged in each of a horizontal direction and a vertical direction to form multiple rows and multiple columns, and includes:

a first flow passage allowing adjacent air pockets in each row to communicate with each other; and a second flow passage allowing adjacent air pockets in each column to communicate with each other.

3. The air mattress of claim 2, wherein the bottom plate includes:

multiple nozzles supplying or discharging air to or from the air pockets and allowing the rows of the air pockets to communicate with each other;

a supply line connected to the nozzles to supply or discharge the air to or from the air pockets;

a valve connected to the supply line to adjust air supply from an air pump to the air pockets and air discharge from the air pockets; and a section connection line connected to the nozzles to allow rows of the multiple rows of the air pockets to communicate with each other, the rows of the multiple rows between which the second flow passage is not formed.

4. The air mattress of claim 1, wherein the air pocket unit includes:

a first air pocket module; and a second air pocket module disposed in contact with the first air pocket module such that row arrangement of the air pockets thereof is symmetrical with row arrangement of the air pockets of the first air pocket module.

5. The air mattress of claim 4, wherein the air pocket unit includes:

a first section where a user's shoulder is located and formed by at least one row of the air pocket unit;

a second section where a user's waist is located and formed by at least one row of the air pocket unit;

a third section where user's buttocks are located and formed by at least one row of the air pocket unit; and a fourth section where user's thighs and knees are located and formed by multiple rows of the air pocket unit.

6. The air mattress of claim 5, wherein the controller adjusts pressure of the air pockets for each section of the first section, the second section, the third section, and the fourth section.

7. The air mattress of claim 6, wherein the bottom plate is provided with a nozzle supplying and discharging air to and from the air pockets, wherein at least one nozzle is provided in each of the first section, the second section, the third section, and the fourth section.

8. The air mattress of claim 5, wherein the pressure sensor unit measures pressure of the air pockets for each section of the first section, the second section, the third section, and the fourth section.

9. The air mattress of claim 1, wherein the air pocket unit is disposed at each of left and right sides of the body portion and is individually controlled by the controller.

* * * * *